US005346792A

United States Patent [19]

Kobayashi et al.

[11] Patent Number: 5,346,792

[45] Date of Patent: Sep. 13, 1994

[54] COLOR TONER

[75] Inventors: Hiroyuki Kobayashi; Takaaki Kohtaki, both of Yokohama, Japan

[73] Assignee: Canon Kabushiki Kaisha, Tokyo, Japan

[21] Appl. No.: 895,046

[22] Filed: Jun. 8, 1992

[30] Foreign Application Priority Data

Jun. 11, 1991 [JP] Japan ..... 3-139095

[51] Int. Cl.[5] ..... G03G 9/087

[52] U.S. Cl. ..... 430/109; 430/904

[58] Field of Search ..... 430/109, 904, 106

[56] References Cited

U.S. PATENT DOCUMENTS

| | | | |
|---|---|---|---|
| 3,681,106 | 8/1972 | Burns et al. | 117/17.5 |
| 4,533,614 | 8/1985 | Fukumoto et al. | 430/904 |
| 5,143,809 | 9/1992 | Kaneko et al. | 430/106 |

FOREIGN PATENT DOCUMENTS

| | | |
|---|---|---|
| 47-12334 | 6/1972 | Japan . |
| 50-82442 | 7/1975 | Japan . |
| 51-144625 | 12/1976 | Japan . |
| 57-37353 | 3/1982 | Japan . |
| 57-109825 | 7/1982 | Japan . |
| 57-208559 | 12/1982 | Japan . |
| 59-7960 | 1/1984 | Japan . |
| 59-29256 | 2/1984 | Japan . |
| 59-57256 | 4/1984 | Japan . |
| 62-7859 | 1/1987 | Japan . |
| 62-78568 | 4/1987 | Japan . |
| 62-195676 | 8/1987 | Japan . |
| 62-195678 | 8/1987 | Japan . |
| 62-195680 | 8/1987 | Japan . |
| 1-224776 | 9/1989 | Japan . |
| 2-73366 | 3/1990 | Japan . |

*Primary Examiner*—Christopher Rodee

*Attorney, Agent, or Firm*—Fitzpatrick, Cella, Harper & Scinto

[57] ABSTRACT

A color toner is constituted to form a polyester binder resin and a colorant. The polyester resin is obtained from a monomer mixture including, at least: 25–35 mol. % of a dibasic aromatic acid component (a) selected from isophthalic acid, terephthalic acid and derivatives thereof; 2–4 mol. % of a tribasic aromatic acid component (b) selected from trimellitic acid and derivatives thereof; 12–18 mol. % of a dibasic acid component (c) selected from dodecenylsuccinic acid, octylsuccinic acid, and anhydrides thereof; and 45–60 mol. % of an etherified diphenol component (d) obtained by propoxidation or/and epoxidation, each percentage being based on a total of the monomers. The polyester resin is characterized by having a hydroxyl value of 10–20, a weight-average molecular weight (Mw) of 13,000–20,000, a number-average molecular weight (Mn) of 5,000–8,000, and an Mw/Mn ratio of 2–3.5.

17 Claims, 2 Drawing Sheets

COLOR TONER

FIELD OF THE INVENTION AND RELATED ART

The present invention relates to a color toner, particularly a color toner which has an excellent color reproducibility of a color image and is less liable to be attached to a fixing roller, thus being excellent in anti-offset characteristics.

In recent years, there has been remarkable development from monochromatic copying machines to full-color copying machines, and two-color copying machines and digitalized full-color copying machines are being gradually available on the market.

Full-color image formation by electro-photography is generally performed by using toners in three primary colors of yellow, magenta and cyan, or toners in four colors including a black toner, in addition thereto, for color reproduction.

Generally, light from an original is passed through a color separation filter in a complementary color with respect to a toner color to fall on a photoconductor layer to form an electrostatic latent image thereon, followed by development and transfer to form a toner image on a support (toner-receiving member), such as plain paper or an OHP film. The above steps are repeated successively in plural cycles for respective colors while effecting registration, whereby plural colors of toner images are superposed on a single support to finally provide a full-color image through a single fixing step.

In such a multi-color or full-color image forming method including plural times of development and a fixing step for superposing several toner layers of different colors, the fixing characteristics of the color toners is a very important factor.

The fixed toner is required to suppress random reflection due to toner particles and show an appropriate degree of luster or gloss. Further, the color toner to be used is required to show a transparency, not hinder the hue of a lower toner layer of a different color, and show a broad color reproducibility.

Color toners comprising novel binder resins and colorants have been proposed by our research group for satisfying the above requirements in Japanese Laid-Open Patent Applications (JP-A) 50-82442, 51-144625 and 59-157256.

These color toners are characterized by such a sharp melting characteristic as to cause a remarkable decrease in viscosity upon a temperature increase of from several degrees to ten and several degrees, and show an almost complete melting state to be deformed and show desired gloss and color reproducibility when used in combination with a silicone rubber roller to which an silicone oil is applied.

The above effects depend on a viscosity term rather than an elasticity term of the viscoelasticity of the binder resin. When the toner viscosity is lowered on heating, the toner behaves as a low-viscosity substance to show an increased heat-fixability and better gloss.

However, the designing of a binder resin placing a greater weight on the viscosity term leads to a decrease in polymer cohesion at the time of hot melting and thus an increase in toner sticking onto the hot roller when it passes through a fixing device. This results in a high-temperature offset phenomenon.

In the case where a silicone rubber roller is used as a fixing roller, the rubber roller causes a decrease in releasability on repetitive use regardless of whether a release oil is applied or not, thus being liable to cause a high-temperature offset. At the initial stage of using a silicone rubber roller, the roller surface is smooth and clean so that it retains a source degree of releasability. However, in the case of repetitive formation of color images which show a larger image area and a much larger toner amount on a unit area of toner support such as plain paper, compared with monochromatic copy images, the releasability of the roller is lowered. The rate of the releasability decrease amounts to several times that in the case of monochromatic image copying.

As described above, a low-viscosity toner has almost no elasticity, so that the toner has almost no anti-offset characteristic. As a result, a film or particles of the toner remain attached onto the hot fixing roller after fixation of several thousands to several tens of thousands sheets, thus causing high-temperature offset or peeling of an upper layer of a toner image at the time of passing through hot fixing rollers.

In order to solve or alleviate the above problems, several measures have been considered taken with respect to the toner. For example, it has been proposed to incorporate a release or anti-offset agent, such as low-molecular weight polyethylene or polypropylene, wax, or higher fatty acids. This measure is effective for preventing offset, but the inclusion of such an agent in a large amount sufficient to effect the anti-offset effect leads to noticeably inadequate compatibility between the main binder agent and the anti-offset agent, thus being liable to cause difficulties, such as impaired transparency of color toner OHP images, unstable toner chargeability and worse successive copying characteristic for a large number of sheets. Thus, the measure is not sufficient for a color toner.

JP-A 47-12334, JP-A 57-37353 and JP-A 57-208559 have proposed a toner including as a binder a polyester of a non-linear copolymer obtained from a monomer mixture comprising an etherified bisphenol monomer, a dicarboxylic acid monomer, a tri- or higher-functional polyhydric alcohol monomer and/or a tri- or higher-functional polyfunctional carboxylic acid monomer. According to this method, the toner is provided with anti-offset characteristic by inclusion as a binder of the polyester which has been obtained by crosslinking a polyester of an etherified bisphenol monomer and a dicarboxylic acid monomer with a large amount of a tri- or higher-functional polyhydric alcohol and/or a tri- or higher-functional carboxylic acid monomer. While being practically satisfactory with respect to an anti-offset characteristic, such a toner is caused to have a somewhat higher softening point, thus failing to provide a good low-temperature fixation characteristic. Further, when used in full-color copying, the toner is accompanied with some difficulty with respect to fixing characteristic and sharp melting characteristic, so that the toner leaves problems with respect to color mixing or color reproducing characteristic by superposition of color toners.

JP-A 57-109825, JP-A 62-78568, JP-A 62-7859, JP-A 59-7960 and JP-A 59-29256 have proposed a toner containing as a binder a non-linear polyester having a saturated or unsaturated hydrocarbon group including 3 to 22 carbon atoms, which has been prepared from an etherified bisphenol monomer, a dicarboxylic monomer having introduced a long-chain aliphatic hydrocarbon group or another dicarboxylic acid monomer, a tri- or higher-functional polyhydric alcohol and/or a tri- or higher-functional polyfunctional carboxylic acid monomer. The polyester resin has been proposed principally for a toner for high-speed copying and is provided with a viscoelasticity including an enhanced elasticity, utterly contrary to the above-mentioned low-viscosity-oriented polyester, so as to remarkably suppress high-temperature offset onto a hot fixing roller. At the time of fixation, the heat and pressure between the hot fixing roller and pressure roller are enhanced to the maximum so as to accomplish the above object by hot pressure fixation wherein the toner in a half-melted state is pushed in between fibers constituting toner-receiving paper.

Accordingly, by using toners containing such polyesters, it is almost impossible to form a continuously melted film layer of a toner giving a smooth surface required for color copying, and thus the fixed toner remains in the form of particles on the paper. As a result, in the case of a color toner, the resultant color image becomes somber and lacks saturation and, in case of an OHP image, retains toner particles causing scattering and diffusion of light, thus failing to transmit sufficient light and being unsatisfactory as a color OHP image.

JP-A H2-73366 and JP-A H1-224776 have proposed a novel polyester resin which is excellent in anti-offset characteristic at high temperatures and is applicable to color copying. The resin shows a better anti-offset characteristic than a conventional resin for color toners but can retain the anti-offset effect for a hot fixing roller only for copying of $2-5\times10^4$ sheets at most. On the other hand, a conventional color toner shows an anti-offset effect for copying of well above $10\times10^4$ sheets and even shows successive copying characteristic and anti-offset characteristic of up to several tens$\times10^4$ sheets at present. In view of this, a color toner having a further improved performance is desired. The polyester resin disclosed in the above JP-A references is liable to provide a toner which has a large difference in chargeability between a low temperature—low humidity environment and a high temperature—high humidity environment, is liable to provide a color image having a somewhat low density after repetitive copying in a low humidity environment, and sometimes causes toner scattering or fog in a high humidity environment. Accordingly, improvement thereof is desired.

JP-A 62-195676, JP-A 62-195678 and JP-A 62-195680 have proposed polyester resins defined by a ratio of an hydroxyl value and an acid value. These polyester resins have been also intended for high-speed fixation. According to our study, however, color toners having a sufficient mixing characteristic have not yet been obtained by using the polyester resins.

As a problem peculiar to color copying, it is necessary to obtain a harmony of color balance among at least three color toners and it is meaningless to discuss the fixing characteristic and color reproducibility of only one color.

Theoretically, it is expected that almost all colors can be reproduced by subtractive mixing from three primary colors of yellow, magenta and cyan. Accordingly, full-color copying machines available on the market have adopted a system wherein color toners of three primary colors are superposed. Ideally, it is excellent that all colors are reproduced over the entire density range. Actually, however, there has been left much room for improvement with respect to such aspects as spectral reflection characteristic of a toner, mixing characteristic and decrease in saturation at the time of superposition of toners.

In case of obtaining black color by superposition of three colors, three toner layers are formed on transfer-receiving paper, and there is encountered a further difficulty with respect to anti-offset characteristic than a single color toner layer. For this reason, there is still a desire for a color toner having a good balance among fixability, mixing characteristic and anti-offset characteristic at the time of hot pressure fixation.

SUMMARY OF THE INVENTION

An object of the present invention is to provide a color toner that resolves the above-mentioned problems.

A more specific object of the invention is to provide a color toner having good fixation and color mixing characteristics.

Another object of the invention is to provide a color toner having a sufficient triboelectric chargeability.

An object of the invention is to provide a color toner capable of forming a fixed toner image showing a high gloss.

An object of the invention is to provide a color toner free from staining carrier particles or a developing sleeve surface after image formation on a large number of sheets.

An object of the invention is to provide a color toner having excellent successive copying characteristics on a large number of sheets.

An object of the invention is to provide a color toner causing no or suppressed high-temperature offset and showing a broad fixable temperature range.

A further object of the invention is to provide a color toner showing an excellent anti-offset characteristic even onto a repeatedly used hot roller.

According to the present invention, there is provided a color toner, comprising: a binder resin and a colorant; the binder resin comprising a polyester resin obtained from a monomer mixture including, at least:

25–35 mol. % of a dibasic aromatic acid component (a) selected from isophthalic acid, terephthalic acid and derivatives thereof, 2–4 mol. % of a tribasic aromatic acid component (b) selected from trimellitic acid and derivatives thereof, 12–18 mol. % of a dibasic acid component (c) selected from dodecenylsuccinic acid, octylsuccinic acid, and anhydrides thereof, and 45–60 mol. % of an etherified diphenol component (d) obtained by propoxidation or/and epoxidation, each percentage being based on a total of the monomers, wherein the polyester resin has a hydroxyl value of 10–20, a weight-average molecular weight (Mw) of 13,000–20,000, a number-average molecular weight (Mn) of 5,000–8,000, and a weight-average molecular weight/number-average molecular weight (Mw/Mn) ratio of 2–3.5.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
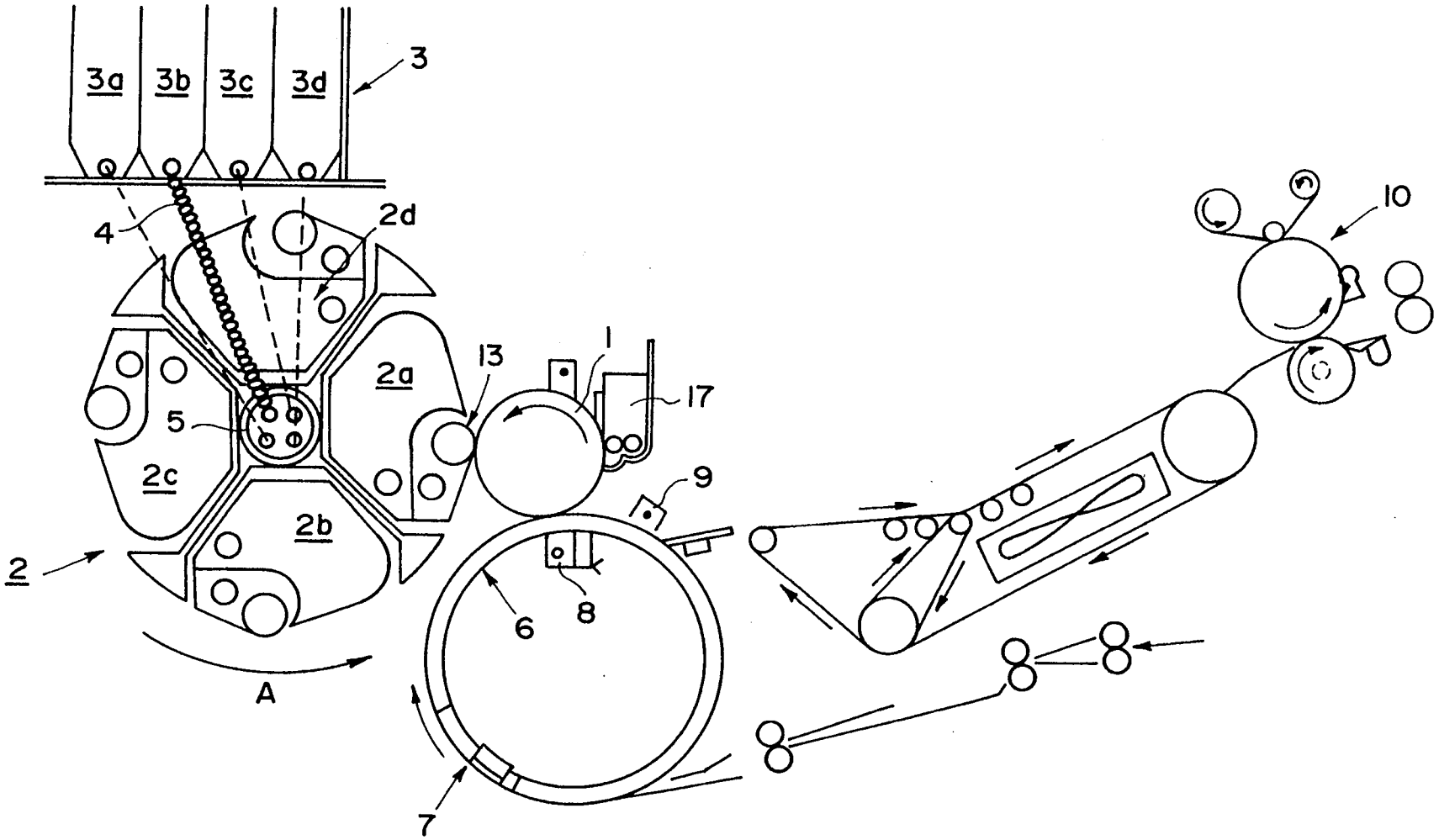
FIG. 1 is a schematic sectional view showing an outline of a full-color copying machine in which the color toner according to the present invention may be used.

The polyester resin constituting the color toner according to the present invention has good properties of both a linear polyester resin and a non-linear crosslinked polyester resin in combination, thereby to provide a color toner with good color mixing characteristic and color reproducibility as well as good anti-offset characteristic for a hot fixing roller.

Some specific examples of the monomers constituting the polyester resin used in the present invention are shown hereinbelow.

(i) Dibasic aromatic acid component (a):

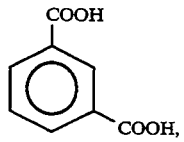

isophthalic acid

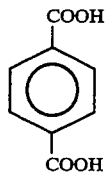

terephthalic acid

Derivatives of these acids, such as diesters and monoesters, may also be used.

(ii) Tribasic aromatic acid component (b):

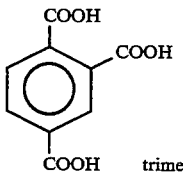

trimellitic acid

Derivatives of trimellitic acid, such as anhydride, triester, diesters and monoesters, may also be used.

(iii) Dibasic aliphatic acid component (c):

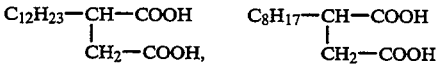

dodecenylsuccinic acid octylsuccinic acid

Derivatives thereof, such as anhydrides, may also be used.

(iv) Etherified diphenol component (d)

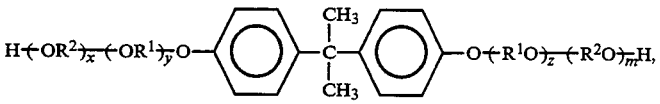

wherein $R^1$ and $R^2$ denote on ethylene or propylene group and may be the same or different, and x, y, z and m are respectively zero or an integer provided that x+y+z+m is preferably 2 or more.

The polyester resin may be prepared from a monomer composition as follows (in a final state):

Component (a):
25–35 mol. %, preferably 27–33 mol. %,
Component (b):
2–4 mol. %, preferably 2.5–3.5 mol. %,
Component (c):
12–18 mol. %, preferably 14–18 mol. %,
Component (d):
45–60 mol. %, preferably 47–58 mol %, with each percentage being based on the total monomer.

The polyester resin can be prepared by a single state of a monomer mixture containing the above components (a), (b), (c) and (d) in the prescribed amounts, but may preferably be prepared by first preparing a non-crosslinked polyester chain from the components (a), (b) and (d) and then forming a crosslinked structure by adding the component (b) as described in Production Examples appearing hereinafter.

The prepared properties of the polyester resin may be attributable to the following factors.

(i) A crosslinked structure with a low degree of crosslinkage may be formed, wherein at most one molecule of trimellitic acid as a crosslinking monomer component is regularly introduced into a linear condensed chain including 20–30 repetitive condensation units each comprising a molecule of a dibasic acid and a molecule of a diphenol. A three-dimensional structure is formed by such a low degree of crosslinkage in the polyester, whereby the anti-offset characteristic is remarkably improved compared with a simple mixture of linear polyesters. The degree of the crosslinkage in the polyester resin used in the present invention is with such an extent that the thermal mobility of the polyester resin is not hindered thereby.

(ii) The species and amount of a dibasic acid having a long-chain substituent, such as dodecenyl group or octyl group, as a soft segment for providing a softness are strictly restricted, whereby the toner is provided with good color mixing and color reproducing characteristics without sacrificing the anti-offset characteristic. The amounts of the tribasic acid component as a crosslinking agent and the dibasic acid having a soft segment are determined in specifically narrow ranges so as to provide a good balance in the weakly crosslinked polyester molecule (condensate). There have been observed tendencies such that an excessive amount of the dibasic acid having a soft segment leads to an excessively sharp melting characteristic, and too small an amount leads to a lowering in gloss or saturation of the resultant color images. In the present invention, the above effects are accomplished by providing the polyester resin with a narrower molecular weight distribution (Mw/Mn=2–3.5, preferably 2.0–3.0) than a conventional crosslinked binder resin or non-crosslinked polyester resin while utilizing a tribasic carboxylic acid as an essential component.

(iii) An aromatic acid of isophthalic acid or terephthalic acid is used as another dibasic acid component, so as to provide a composition having a certain degree of elasticity without lowering the viscosity of the polyester resin. In contrast thereto, in case where an aliphatic acid component is used, the resultant polyester is caused to have a linear and long molecular chain rich in mobility and show an excessively viscous behavior, thus being liable to cause offset onto a hot fixing roller.

(iv) The polyester resin used in the present invention is particularly adjusted to have a sharp and narrow molecular weight distribution. For the purpose of satisfying the color mixing characteristic and anti-offset characteristic of a color toner, it is important to uniformize the condensate molecular chain in the polyester resin within a narrow range. More specifically, a condensate having a low molecular weight and a short molecular chain easily causes movement of its molecular chain on heating and, reversely, a condensate having a high molecular weight and a long molecular chain does not substantially cause movement of the molecular chain at a thermal energy given by the same degree of heating. In the case of using a color toner comprising a polyester resin having a broad molecular weight distribution (unbalanced molecular weight), a low-molecular weight condensate quickly melts but a high-molecular weight condensate does not substantially melt, thus resulting in a non-uniform fixing state. On the other hand, when the hot fixing roller is heated to such a high temperature as to cause melting of the high-molecular weight condensate, the low-molecular weight condensate behaves as a viscous substance showing utterly no elasticity, thus causing high-temperature offset.

Accordingly, in a color toner, it is preferred that the polyester resin has as small an Mw/Mn ratio as possible so as to have a relatively sharp melting characteristic and also an enhanced cohesion between molecules. This is a unique and important property not derivable from the fixability and anti-offset characteristic of a monochromatic toner.

(v) The conditions for production of a polyester resin significantly affect the control of molecular weight distribution of the polyester resin. The production conditions are also important for restricting the hydroxyl value within a prescribed range. The hydroxyl value is a measure of hydrophilicity of a resin and is an important factor affecting the triboelectric chargeability of the resulting color toner. Thus, it is difficult to obtain a desired chargeability of a toner when the hydroxyl value is too large or too small. The hydroxyl value is determined by the monomer composition for the polyester resin and the production conditions.

It is important to satisfy the above conditions (i)–(v) in combination in order to provide a color toner satisfying good color-mixing characteristic, color reproducibility, fixability including anti-offset characteristics and chargeability.

The polyester resin used in the present invention has a hydroxyl value of 10 to 20 (mg KOH/g), a Mw of 13,000 to 20,000, an Mn of 5,000 to 8,000, and an Mw/Mn ratio of 2 to 3.5. The polyester resin may preferably have a glass transition point (Tg) of 55 to 66° C., a hydroxyl value of 12 to 18 (mg KOH/g), an Mw of 14,000 to 19,000, an Mn of 5,300 to 7,500 and an Mw/Mn ratio of 2.0 to 3.0.

A color toner satisfying the objects of the present invention may be provided by using a polyester resin satisfying the above-mentioned aspects of monomers, composition, and properties.

A preferred class of the etherified diphenol may include etherified bisphenols, which may preferably be ethoxydated or/and propoxydated to have 2–3 mols in total of oxyethylene or/and oxypropylene per mol of bisphenol.

Examples of the etherified diphenol may include polyoxypropylene (2.2)-2,2-bis(4-hydroxyphenyl)propane and polyoxyethylene-(2)-2,2-bis(4-hydroxyphenyl)propane.

The colorant used in the color toner of the present invention may include organic dyes and pigments and preferably include: disazo-type pigments, non-soluble azo-type pigments, copper phthalocyanine-type pigments, basic dyes and oil-soluble dyes.

Specific examples of the dyes may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, etc.

Specific examples of the pigments may include: Naphthol Yellow S, Hansa Yellow G, Permanent Yellow NCG, Permanent Orange GTR, Pyrazolone Orange, Benzidene Orange G, Permanent Red 4R, Watching Red Ca salt, Brilliant Carmine 38, Fast Violet B, Methyl Violet Lake, Phthalocyanine Blue, Fast Sky Blue, Indanthrene Blue BCG, etc.

Particularly preferred examples of the pigments may include: C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, and copper phthalocyanine pigments having 2–3 substituents to a phthalocyanine skeleton represented by the following structural formula: [I]

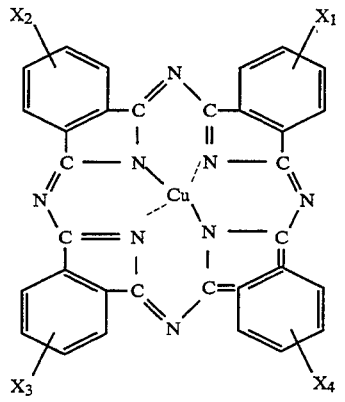

[I]

Wherein $X_1$, $X_2$, $X_3$ and $X_4$ respectively denote

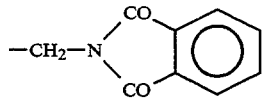

or H with the proviso that all of $X_1$–$X_4$ cannot be H.

Particularly preferred examples of the dyes may include: C.I. Solvent Red 49, C.I. Solvent Red 52, C.I.

Solvent Red 109, C.I. Basic Red 12, C.I. Basic Red 1, C.I. Basic Red 3*b*, etc.

The amount of the colorant in a yellow toner affecting the transmissivity of an OHP film may preferably be at most 12 wt. parts, more preferably 0.5–7 wt. parts, per 100 wt. parts of the binder resin. An amount exceeding 12 wt. parts results in poor reproducibility of green, red and the color of human skin formed by mixing of another color with yellow.

Regarding the magenta toner and the cyan toner, the colorants may preferably be used in amounts of at most 15 wt. parts, more preferably 0.1 to 9 wt. parts, per 100 wt. parts of the binder resin.

A colorant having a poor light-fastness, such as C.I. Disperse Y164, C.I. Solvent Y77 or C.I. Solvent Y93, is not advisable as a colorant for a color toner.

In order to stabilize the chargeability of the color toner according to the present invention, a charge control agent may be added preferably. The charge control agent may preferably be a negative charge control agent which is colorless or light-colored. Preferred examples of the charge control agent may include: salicylic acid metal complexes, alkylsalicylic acid metal complexes, dialkylsalicylic acid metal complexes and oxynaphthoic acid metal complexes. The metal ion constituting the complexes may for example be chromium ion or zinc ion.

The carrier used in combination with the color toner of the present invention may be composed of, e.g., iron or an alloy of iron with nickel, copper, zinc, cobalt, manganese, chromium, and rare earth elements in the surface oxidized form or in the surface non-oxidized form, or of an oxide or ferrite formed of these metal or alloys. The carrier may be produced in an arbitrary manner.

In the present invention, it is preferred to use a coated carrier, e.g., by dip-coating the surface of the carrier with a resin, in view of durability. The carrier may preferably be coated with a coating material such as resin by known methods such as those wherein the carrier is dipped in a solution or suspension of a coating material, or the carrier and the resin are simply mixed in their powder states, etc.

The coating material on the carrier surface may, for example, be polytetrafluoroethylene, monochlorotrifluoroethylene polymer, polyvinylidene fluoride, silicone resin, polyester resin, styrene-type resin, acrylic resin, polyamide, polyvinylbutyral, nigrosine, aminoacrylate resin, basic dye or its lake, silica fine powder, alumina fine powder and metal complexes or metal salts of dialkylsalicylic acids. These coating materials may be used singly or in combination.

The coating amount of the above coating material may appropriately be determined but may generally be in a proportion of 0.1 to 30 wt. %, preferably 0.5 to 20 wt. %, in total, based on the carrier.

The carrier may preferably have an average particle size of 20 to 100 microns, more preferably 25–70 microns, further preferably 25 to 65 microns.

The carrier, in its particularly preferred form, may be composed of ternary magnetic ferrite of Cu-Zn-Fe (5 to 20: 5 to 20: 30 to 80 by weight) surface-coated with a fluorine-containing resin, a styrene-type resin, or a combination of these resins. Examples of the combination include polyvinylidene fluoride and styrene-methyl methacrylate resin; polytetrafluoroethylene and styrene-methyl methacrylate resin; and fluorine-containing copolymer and styrene-type copolymer. The proportions of the fluorine-containing resin and the styrene-type resin may be 90:10 to 20:80, preferably 70:30 to 30:70. It is preferred to coat the ferrite particles with 0.01 to 5 wt. %, particularly 0.1 to 1 wt. %, of the coating agent. The carrier may preferably have a particle size distribution such that particles in the range of 250 mesh-pass and 400 mesh-on occupy 70 wt. % or more. A further preferred example of the fluorine-containing resin includes vinylidene fluoride-tetrafluoroethylene copolymer (10:90 to 90:10) and examples of the styrene-type copolymer include styrene-2-ethylhexyl acrylate copolymer (20:80 to 80:20) and styrene-2-ethylhexyl acrylate-methyl methacrylate copolymer (20 to 60: 5 to 30: 10 to 50).

The coated ferrite carrier having a sharp particle size distribution, provides a preferable triboelectric charge and provides a developer with improved electrophotographic characteristics, when combined with the color toner of the present invention.

A two-component developer may be prepared by mixing a color toner according to the present invention with a carrier so as to give a toner concentration in the developer of 1.0 to 15 wt. %, preferably 2.0 to 13 wt. %, which generally provides good results. A toner concentration of below 1.0% results in a low image density, and a toner concentration of above 15% is liable to result in increased fog and scattering of toner in the apparatus and a decrease in life of the developer.

The toner according to the invention may include a fluidity improver, which may be any substance that can be mixed with toner particles to increase the fluidity. Examples of such a fluidity improver may include: hydrophobic colloidal silica fine powder, colloidal silica fine powder, hydrophobic titanium oxide fine powder, titanium oxide fine powder, hydrophobic alumina fine powder, alumina fine powder, and mixtures of these powders. Particularly improved triboelectric chargeability and successive image forming characteristics on a large number of sheets, may be obtained when the color toner of the present invention is mixed with a fluidity improver, such as hydrophobic colloidal silica fine powder and hydrophobic titanium oxide fine powder.

The properties characterizing the color toner of the present invention may be measured in the following manner.

(1) Glass transition point

A differential scanning calorimeter DSC-7 (available from Perkin Elmer Corp.) is used.

Figure 2:
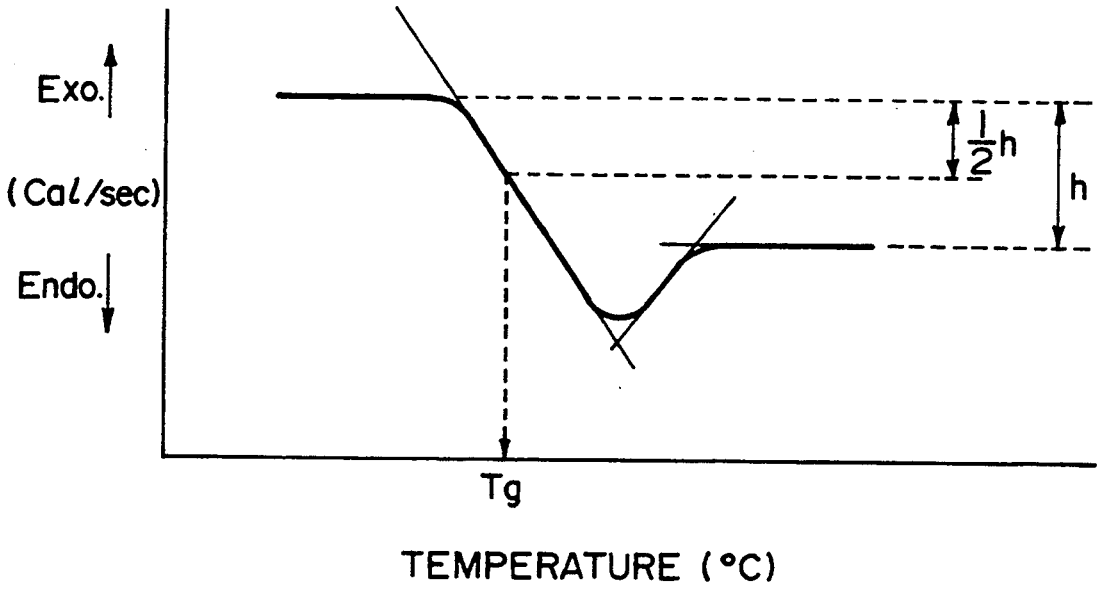
FIG. 2 is a graph showing a glass transition point of a resin or a toner.

A sample is accurately weighed at 5–20 mg, preferably about 10 mg. The sample is placed on an aluminum pan with the use of an empty aluminum pan as the reference. For the purpose of removing the history, a pretreatment is performed in the nitrogen atmosphere by raising the temperature from room temperature to 200° C. at a rate of 10° C./min, keeping the temperature at 200° C. for 10 min, then lowering the temperature to 10° C. by rapid cooling and keeping the temperature at 10° C. for 10 min. Then, a measurement cycle is followed, wherein the temperature is raised up to 200° C. at a rate of 10° C./min. During the course of the temperature increase, a heat absorption peak is found including a main peak in the range of from about 40 to about 100° C. In the instance, a temperature on the resultant DSC curve as shown in FIG. 2 at a mid height between two base lines respectively before and after the heat absorption peak, is determined as the glass transition point of the sample.

(2) Weight-average molecular weight (Mw) and number-average molecular weight (Mn)

A GPC (gel permeation chromatography) apparatus ("Model HLC-802A", available from Toyo Soda K.K.) loaded with a column ("TSK gel GMH 6×2", available from Toyo Soda K.K.), for example, is used together with an RI (refractive index) meter as a detector and a solvent, THF.

Through a column stabilized in a heat chamber at 40° C., THF (tetrahydrofuran) as the solvent is permitted to flow at a rate of 1 ml/min., and about 200 μl of a THF sample solution of a resin controlled to a sample concentration of about 0.5 wt. % is injected for measurement. In measuring the molecular weight of the sample, the molecular weight distribution possessed by the sample is calculated based on a calibration curve prepared from several kinds of mono-dispersed polystyrene standard samples showing a relationship between the logarithmic value of the molecular weights and the count numbers. As the standard polystyrene samples for preparation of the calibration curve, for example, those produced by Pressure Chemical Co. or Toyo Soda Kogyo K.K., having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2.10^6$ and $4.48\times10^6$ may be employed, and it is suitable to use at least 10 points of standard polystyrene samples.

(3) Hydroxyl value

The following method is used according to JIS K 007.

About 6 g of a sample is accurately weighed to an accuracy of 1 mg and placed in a 200 ml Erlenmeyer flask. A mixture solution of anhydrous acetic acid/pyridine (=¼) is added by a 5 ml-whole pipet, and 25 ml of pyridine is added by a measuring cylinder. Then, a cooler is attached to the mouth of the Erlenmeyer flask, and the content is subjected to 90 min. of reaction on an oil bath at 100° C.

3 ml of distilled water is added from the top of the cooler are the flask is well shaken and then left standing for 10 min. The flask is removed from the oil bath together with the cooler and, at a time when the temperature reaches about 30° C., the cooler and the mouth of the flask is washed with a small amount (about 10 ml) of acetone. Then, 50 ml of THF is added by a measuring cylinder, and the content is titrated to neutrality with 0.5 N KOH-THF solution by using a 50 ml-buret (with a graduation unit of 0.1 ml) and a phenolphthalein-alcohol solution as the indicator. Immediately before the end point of the neutralization, 25 ml of neutral alcohol (methanol/acetone=1/1 (vol)) is added, and the titration is continued until the solution turns to light-red color. A blank test is also performed in parallel.

The hydroxyl value is calculated by the following equation.

Hydroxyl value (mg KOH/g)=(B-A)×f×28.05/S)+C, wherein

A: The volume (ml) of the 0.5N-KOH-THF solution used in the measurement.

B: The volume (ml) of the 0.5N-KOH-THF solution used in the blank test.

f: The titer of the 0.5N-KOH-THF solution.

S: The weight (g) of the sample.

C: Acid value or alkali value with the proviso that the acid value is added and the alkali value is subtracted.

The hydroxyl value is determined as an average of twice-measured values.

(4) Gloss

A solid image used for chromaticity measurement is used for measurement by a gloss meter (Model "VG-10", available from Nihon Denshoku K.K.).

For the measurement, 6 V is set by a constant voltage regulator. The light-incidence angle and light reflection angle are respectively set at 60 degrees. The standard adjustment is performed by using a zero-adjustment standard plate. Then, a sample image having an image density of 1.5±0.1 is placed on a sample support for measurement, followed by placement of 3 sheets of white paper to read a percentage value on the indicator. At this time, the S-S/10 changeover switch is set to the "S" position and the angle-sensitivity changeover switch is set to the position of "45-60".

The polyester resin may, for example, be prepared in the following manner.

A linear condensate is first formed while adjusting the molecular weight so as to obtain an acid value and a hydroxyl value which are 1.5 to 3 times the objective values. The condensation reaction is caused in a controlled manner at a velocity slower than a conventional one so as to provide a uniform molecular weight, e.g., by using a lower temperature and a longer period, by using a smaller amount of or a smaller activity of esterification promoter, or by combining these measures. Then, under such conditions, a crosslinking acid component (b) and optionally a further amount of esterification promoter are added for reaction to form a three-dimensional condensate.

Then, the temperature is raised to cause the crosslinking reaction slowly in a long period of time so as to provide a uniform molecular weight distribution. The reaction is terminated when the hydroxyl values is lowered down to the objective value to obtain a polyester resin of the present invention.

An example of a full-color electro-photographic copying machine to which the color toner according to the present invention may be applied is explained with reference to FIG. 1.

An electrostatic latent image formed on a photosensitive drum 1 by appropriate means is developed by a developer comprising a first color toner and a carrier contained in a developing device 2*a* fixed on a rotary developing unit 2. The resultant toner image on the photosensitive drum 1 is transferred by the operation of a transfer charger 8 onto a transfer material such as plain paper held on a transfer drum 6 by a gripper 7. A residual toner remaining on the photosensitive drum 1 is removed by a cleaning means 17.

For a second color development and transfer, the rotary developing unit 2 is rotated to have a developing device 2*b* face the photosensitive drum 1. A latent image on the photosensitive drum 1 is then developed by a developer comprising a second color toner and a carrier in the developing device 2*b*, and the resultant color toner image is also transferred in superposition on the same transfer material as described above.

The development and transfer are similarly conducted for third and fourth colors. In this way, the transfer drum 6 is rotated in a prescribed number of times while holding thereon the transfer material to transfer the prescribed number of color images in superposition. The corona charge for electrostatic transfer is preferably successively increased for successive color toner images by increasing the transfer current such that transfer current for first color < transfer current for second color < transfer current for third color < transfer current for fourth color, in order to reduce the amount of residual toner on the photosensitive drum after the transfer. The transfer material after the multiple transfer is separated from the transfer drum 6 by means of a separation charger 9 and passed through a hot pressure roller fixer 10 equipped with a web impregnated with silicone oil to provide a full-color copy image by subtractive color mixing at the time of the fixation.

Replenishing toners supplied to developing devices 2*a* to 2*d* are supplied from replenishing hoppers 3 provided for respective color toners in a constant amount based on a replenishing signal through toner-conveying cables 4 to toner replenishing tubes 5 disposed at the center of the rotary developing unit 2 and then sent to the respective developing devices.

Hereinbelow, the present invention is described in more detail with reference to Production Examples and Examples.

PRODUCTION EXAMPLE 1 OF POLYESTER RESIN (INVENTION)

2 mol of terephthalic acid, 1.09 mol of dodecenylsuccinic anhydride, 3.4 mol of polyoxypropylene (2.2)-2,2-bis(4-hydroxyphenyl)propane, and 0.01 g of dibutyltin oxide were charged in a 2 liter-four-necked glass flask, to which were then attached a thermometer, a stirring bar, a condenser, and a nitrogen-supply pipe. The flask was then placed in a mantle heater and the interior thereof was aerated with nitrogen. The content was gradually heated under stirring, reacted for 5 hours at 170° C., and then heated to and reacted at 190° C. for four hours. The resin produced at this stage showed a hydroxyl value of 59.8.

Then, 0.2 mol of trimellitic anhydride and 0.08 g of dibutyltin oxide were added to the system, and the mixture was subjected to further 3 hours of reaction at 190° C., followed by heating at 190° C. and 5 hours of reaction at that temperature to complete the reaction, whereby a crosslinked polyester resin (1) according to the present invention was obtained.

The polyester resin (1) showed a hydroxyl value of 16.8, a glass transition point of 64° C., a weight-average molecular weight (Mw) of 16,000, a number-average molecular weight (Mn) of 5,900, and an Mw/Mn ratio of about 2.7.

PRODUCTION EXAMPLE 2 OF POLYESTER RESIN (INVENTION)

1.8 mol of isophthalic acid, 1.16 mol of octylsuccinic acid, and 3.34 mol of polyoxyethylene (2.0)-2,2-bis(4-hydroxyphenyl)propane were reacted in nitrogen atmosphere in a similar manner as in Production Example 1. Then, 0.13 mol of trimellitic anhydride and 0.09 g of dibutyltin oxide were added, and the resultant mixture was subjected to 5 hours of reaction at 180° C., thus obtaining a crosslinked polyester resin (2) according to the present invention.

The polyester resin (2) showed a hydroxyl value of 14.7, a glass transition point of 62° C., a weight-average molecular weight (Mw) of 17,000, a number-average molecular weight (Mn) of 6,300, and an Mw/Mn ratio of about 2.7.

PRODUCTION EXAMPLE 3 OF POLYESTER RESIN (COMPARATIVE)

5 mol of polyoxypropylene (2.2)-2,2-bis(4-hydroxyphenyl)propane, 2 mol of terephthalic acid, 3 mol of trimellitic anhydride and 0.05 g of dibutyltin oxide were reacted in nitrogen atmosphere at 220° C. by using an apparatus similar to the one used in Production Example 1, whereby a crosslinked polyester resin (3) was obtained. The polyester resin (3) showed an Mw/Mn ratio which was clearly larger than 3.5

PRODUCTION EXAMPLE 4 OF POLYESTER RESIN (COMPARATIVE)

2.0 mol of polyoxypropylene (2.2)-2,2-bis(4-hydroxyphenyl)propane, 2.1 mol of polyoxyethylene (2.0)-2,2-bis(4-hydroxyphenyl)propane, 2 mol of terephthalic acid, 1.6 mol of dodecenylsuccinic acid and 0.46 mol of trimellitic acid were reacted at 250° C. for 8 hours in an apparatus similar to the one used in Production Example 1 to obtain a crosslinked polyester resin (4).

The polyester resin (4) showed a hydroxyl value of 20.4, a glass transition point of 61.5° C., a weight-average molecular weight (Mw) of 110,000, a number-average molecular weight (Mn) of 5,540, and an Mw/Mn ratio of 16.2.

PRODUCTION EXAMPLE 5 OF POLYESTER RESIN (COMPARATIVE)

5.0 mol of polyoxypropylene (2.5)-2,2-bis(4-hydroxyphenyl)propane was charged in a four-necked flask, to which were then attached a thermometer, a stirring bar, a condenser, and a nitrogen-supply pipe. The flask was then placed in a mantle heater and the interior thereof was aerated with nitrogen. The content was heated to 50°–60° C., when 3.0 mol of terephthalic acid, 1.5 mol of dodecenylsuccinic acid and 0.35 mol of trimellitic acid were added.

The mixture was reacted under heating at 210° C. and stirring for 5 hours while removing the produced water from the system, followed by cooling to room temperature to obtain crosslinked polyester resin (5).

The polyester resin (5) showed a weight-average molecular weight (Mw) of 12,500, a number-average molecular weight (Mn) of 3,070, and an Mw/Mn ratio of 4.7.

In the production of the polyester resin (5), all the monomer components were reacted at one time at a high reaction temperature in a shorter reaction time. As a result, the resultant crosslinked polyester resin (5) showed a broader molecular weight distribution and lower average molecular weights. The hydroxyl value was correspondingly increased to 32.

PRODUCTION EXAMPLE 6 OF POLYESTER RESIN (COMPARATIVE)

5 mol of polyoxypropylene (2.2)-2,2-bis(4-hydroxyphenyl)propane, 4.5 mol of fumaric acid and 0.1 g of hydroquinone were reacted in one stage in nitrogen atmosphere at 220° C. by using an apparatus similar to the one used in Production Example 1, whereby a non-crosslinked polyester resin (6) was obtained.

The polyester resin (6) showed a hydroxyl value of 32, a weight-average molecular weight (Mw) of 18,700 a number-average molecular weight (Mn) of 3,270, and an Mw/Mn ratio of about 5.7.

EXAMPLE 1

A cyan color toner was prepared from the following composition.

| | |
|---|---|
| Polyester resin (1) of Production Example 1 | 100.0 wt. parts |
| Copper phthalocyanine pigment (di-substituted) of the structural formula (I) | 4.0 wt. parts |
| 3,5-Di-tert-butylsalicylic acid chromium complex | 4.0 wt. parts |

The above ingredients were sufficiently pre-mixed by a Henschel mixer and then melt-kneaded by a twin-screw extrusion kneader. After cooling, the kneaded product was coarsely crushed to about 1–2 mm by a hammer mill and finely pulverized to a particle size of 40 μm or smaller. The pulverized product was classified to obtain a classified product (toner particles) having a weight-average particle size of 8.2 μm, 100 wt.parts of which was then mixed with 0.8 wt. part of hydrophobic silica fine powder treated with hexamethyldisilazane and 0.5 wt. part of aluminum oxide externally added thereto to obtain a cyan color toner.

5 wt. parts of the cyan color toner was mixed with 95 wt. parts of Cu-Zn-Fe-based magnetic ferrite carrier coated with about 0.35 wt. % of styrene-methyl methacrylate copolymer (copolymerization wt. ratio=65:35) to obtain a developer containing 5 wt. % of the toner.

The developer was subjected to a copying test using a color laser electrophotographic copying machine using an OPC photosensitive drum as shown in FIG. 1. The fixing apparatus 10 included a fixing roller comprising a core metal coated with a single layer of 1 mm-thick HTV (high temperature-vulcanizing) silicone rubber layer and equipped with a web impregnated with silicone oil and a pressing roller surfaced with a 3 mm-thick HTV silicone rubber layer.

The copying speed was 7 sheets (A4)/min., and the silicone oil-impregnated web was moved at a rate of 1 mm/10 sheets (A4) so as to apply the silicone oil at a rate of about 20 mg/sheet (A4).

The resultant cyan toner fixed images were excellent in saturation and bright from the initial stage of the copying.

Further, even after $9\times10^4$ sheets of successive copying of an image having an areal coverage of 5%, cyan toner fixed images free from fog and faithfully reproducing the original were obtained. The transfer and developer density detection were well performed in the copying apparatus to provide a stable image density. In the successive copying of $9\times10^4$ sheets performed at a set fixing temperature of 150° C., toner attachment onto the fixing roller was not caused.

In order to examine the high temperature offset, an accelerated fixing roller staining test was performed as follows. A fresh fixing roller was installed in the fixing apparatus 10. The drive of the silicone oil-impregnated web was stopped, and successive copying of 5000 sheets was performed in this state based on an original image at an areal coverage of 20%. Then, the amount of toner attached to the web (high-temperature offset toner) was evaluated by measuring the density of the toner-attached web part by a Macbeth reflection densitometer, whereby a density of 0.4 was measured.

In this test, a higher reflection density of the toner-attached web part indicates a larger amount of high-temperature offset toner, and a lower density indicates a smaller amount.

The chargeability of the cyan toner was measured in a low temperature—low humidity environment (15° C.–10%RH) and a high temperature—high humidity environment (32.5° C.–85%RH), whereby the triboelectric charges of −23.0 μC/g and −17.0 μC/g were obtained respectively and gave a small charge ratio of 1.35 due to the change in environment, thus showing a very small dependence on environmental conditions.

The gloss of the cyan toner fixed images in Example 1 was measured to be 18%. A higher gloss value is judged to represent a better color image quality corresponding to a smooth and lubtrons image surface showing a higher saturation. Reversely, a lower gloss value is judged to represent a rougher image surface which is somber and worse in saturation.

EXAMPLE 2

| | |
|---|---|
| Polyester resin (1) of Production Example 2 | 100.0 wt. parts |
| C.I. Pigment Red | 5.0 wt. parts |
| 3,5-Di-tert-butylsalicylic acid chromium complex | 4.0 wt. parts |

A magenta toner was prepared from the above ingredients and used to form a magenta developer similarly as in Example 1. The developer was used in an image forming test similarly as in Example 1, whereby magenta toner fixed images were obtained. The fixed images showed a high image density and a bright magenta color. When subjected to a similar successive copying test, the developer caused no offset onto the fixing roller and provided good fixed images free from roughness even after $9\times10^4$ sheets.

EXAMPLE 3

A yellow toner and a yellow developer were prepared in the same manner as in Example 1 except that the colorant was changed to 3.5 wt. parts of C.I. Pigment Yellow 17. The yellow developer, the cyan developer of Example 1 and the magenta developer of Example 2 were used for successive copying of an original image having an image areal percentage of 35 % by using the electrophotographic copying apparatus used in Example 1. As a result, a successive copying durability of at least $8\times10^4$ sheets was observed, and substantially no attachment onto the fixing roller was observed.

Even a full-color copied image after $8\times10^4$ sheets showed a good color mixing characteristic and a high saturation. A solid black image obtained by superposition of the three colors showed a gloss of 23%.

COMPARATIVE EXAMPLES 1–4

Color toners were prepared and tested in the same manner as in Example 1 except that polyester resins (3)–(5) prepared in Production Examples 3–6 were used. The results of evaluation were summarized in the following table together with the results of Examples 1 and 2.

| | Number of successively copied sheets | Toner attachment to fixing roller | Web stain density | Triboelectric charge (μc/g) 23° C., 60% RH | 15° C., 10% RH | 32.5° C. 85% RH | Gloss (%) | Color toner characteristic **3 Anti-offset | Charging | Image quality |
|---|---|---|---|---|---|---|---|---|---|---|
| Example 1 Polyester (1) | $9 \times 10^4$ | None | 0.4 | −21.0 | −23.0 | −18.0 | 18.0 | ○ | ○ | ○ |
| Example 2 Polyester (2) | $9 \times 10^4$ | None | 0.5 | −23.1 | −25.3 | −21.6 | 20 | ○ | ○ | ○ |
| Comp. Ex. 1 Polyester (3) | $9 \times 10^4$ | None | Below 0.1 | −20.5 | −32.5 | −14.3 | 1.3 | ○ | Δ | X |
| Comp. Ex. 2 Polyester (4) | $9 \times 10^4$ | None | 0.2 | −16.6 | −25.3 | −11.5 | 2.2 | ○ | ○Δ | X |
| Comp. Ex. 3 Polyester (5) | $5 \times 10^4$ | **1 | 0.7 | −31.3 | −37.7 | −19.6 | 9.0 | ○Δ | Δ | Δ |
| Comp. Ex. 4 Polyester (6) | $1.5 \times 10^4$ | **2 | 1.3 | −18.7 | −30.0 | −12.3 | 25 | X | Δ | ○ |

Notes to the above Table
**1: Minor offset was slightly observed on the fixing roller surface by naked eye observation.
**2: Conspicuous toner offset was observed on the fixing roller surface by the same observation.
**3: The color toner characteristics including the anti-offset characteristic, charging characteristic and image quality were respectively evaluated according to the following five levels.
○: excellent,
○X: good,
Δ: fair,
ΔX: poor,
X: not acceptable.

Notes to the above Table

**1: Minor offset was slightly observed on the fixing roller surface by naked eye observation.

**2: Conspicuous toner offset was observed on the fixing roller surface by the same observation.

**3: The color toner characteristics including the anti-offset characteristic, charging characteristic and image quality were respectively evaluated according to the following five levels.

○: excellent,
○×: good,
Δ: fair,
Δ×: poor,
×: not acceptable.

As described above, according to the present invention, there is provided a color toner showing excellent color mixing characteristic and anti-offset characteristic in hot-pressure fixation by using a specific polyester binder resin which is slightly crosslinked and has an extremely narrow molecular weight distribution.

What is claimed is:

1. A color toner, comprising: a binder resin and a colorant; the binder resin comprising a polyester resin obtained from a monomer mixture including, at least:

25–35 mol. % of a dibasic aromatic acid component (a) selected from the group consisting of isophthalic acid, terephthalic acid and derivatives thereof, 2–4 mol. % of a tribasic aromatic acid component (b) selected from the group consisting of trimellitic acid and derivatives thereof, 12–18 mol. % of a dibasic acid component (c) selected from the group consisting of dodecenylsuccinic acid, octylsuccinic acid, and anhydrides thereof, and 45–60 mol. % of an etherified diphenol component (d) obtained by propoxidation or/and epoxidation, each percentage being based on a total of the monomers, wherein the polyester resin has a hydroxyl value of 10–20, a weight-average molecular weight (Mw) of 13,000–20,000, a number-average molecular weight (Mn) of 5,000–8,000, and a weight-average molecular weight/number-average molecular weight (Mw/Mn) ratio of 2–3.5.

2. The color toner according to claim 1, wherein the binder resin comprises a crosslinked polyester resin having an Mw/Mn ratio of 2.0–3.0.

3. The color toner according to claim 1, wherein the binder resin comprises a crosslinked polyester resin obtained from terephthalic acid, trimellitic acid or trimellitic anhydride, dodecenylsuccinic acid or dodecenylsuccinic anhydride, and polyoxypropylene-2,2-bis(4-hydroxyphenyl)propane or polyoxyethylene-2,2-bis(4-hydroxyphenyl)propane.

4. The color toner according to claim 1, wherein the binder resin comprises a crosslinked polyester resin obtained from isophthalic acid, trimellitic acid or trimellitic anhydride, octylsuccinic acid or octylsuccinic anhydride, and polyoxypropylene-2,2-bis(4-hydroxyphenyl)propane or polyoxyethylene-2,2-bis(4-hydroxyphenyl)propane.

5. The color toner according to claim 1, wherein the polyester resin has a glass transition point of 55°–60° C., a hydroxyl value of 12–18, a weight-average molecular weight (Mw) of 14,000–19,000, a number-average molecular weight (Mn) of 5,300–7,500, and an Mw/Mn ratio of 2.0–3.0.

6. The color toner according to claim 1, wherein the colorant comprises a yellow colorant.

7. The color toner according to claim 6, wherein the yellow colorant is contained in a proportion of 0.5–7 wt. parts per 100 wt. parts of the binder resin.

8. The color toner according to claim 1, wherein the colorant comprises a magenta colorant.

9. The color toner according to claim 8, wherein the magenta colorant is contained in a proportion of 0.1–9 wt. parts per 100 wt. parts of the binder resin.

10. The color toner according to claim 1, wherein the colorant comprises a cyan colorant.

11. The color toner according to claim 10, wherein the cyan colorant is contained in a proportion of 0.1–9 wt. parts per 100 wt. parts of the binder resin.

12. The color toner according to claim 1, further comprising a charge control agent.

13. The color toner according to claim 12, wherein the charge control agent is a compound selected from the group consisting of salicylic acid metal complexes, alkylsalicylic acid metal complexes, dialkylsalicylic acid metal complexes, and oxynaphthoic acid metal complexes.

14. The color toner according to claim 12, wherein the charge control agent comprises dialkylsalicylic acid chromium complex.

15. The color toner according to claim 12, wherein the charge control agent comprises dialkylsalicylic acid zinc complex.

16. The color toner according to claim 1, which is in mixture with hydrophobic colloidal silica fine powder.

17. The color toner according to claim 1, which is in mixture with hydrophobic titanium oxide fine powder.

* * * * *

UNITED STATES PATENT AND TRADEMARK OFFICE

CERTIFICATE OF CORRECTION

PATENT NO. : 5,346,792

DATED : September 13, 1994

INVENTOR(S) : HIROYUKI KOBAYASHI, ET AL.

It is certified that error appears in the above-identified patent and that said Letters Patent is hereby corrected as shown below:

COLUMN 1

Line 37, "is" should read --are--.
Line 48, "59-157256." should read --59-57256.--.
Line 56, "an" should read --a--.

COLUMN 3

Line 50, "an" should read --a--.

COLUMN 4

Line 3, "characteristic" should read --characteristic,--.

COLUMN 5

Line 63, "on" should read --an--.

COLUMN 9

Line 8, "of" (second occurrence) should be deleted.
Line 14, "a" should be deleted.

COLUMN 11

Line 25, "$2.10^6$" should read --$2\times10^6$--.
Line 40, "are" should read --and-- and
"shaken" should read --shaken,--.
Line 44, "is" should read --are--.

COLUMN 12

Line 36, "values" should read --value--.

UNITED STATES PATENT AND TRADEMARK OFFICE

CERTIFICATE OF CORRECTION

PATENT NO. : 5,346,792

DATED : September 13, 1994

INVENTOR(S) : HIROYUKI KOBAYASHI, ET AL.

It is certified that error appears in the above-identified patent and that said Letters Patent is hereby corrected as shown below:

COLUMN 16

Line 18, "lubtrons" should read --lustrous--.

COLUMN 17

Lines 25-39 should be deleted.

Signed and Sealed this

Twenty-eight Day of February, 1995

*Attest:*

Bruce Lehman

BRUCE LEHMAN

*Attesting Officer*

*Commissioner of Patents and Trademarks*